United States Patent [19]

Goes

[11] 4,033,161

[45] July 5, 1977

[54] FLUID CONTROLLED SECURITY LOCK

[76] Inventor: Michael J. Goes, 3256-B Picatinny Arsenal, Dover, N.J. 07801

[22] Filed: Mar. 1, 1976

[21] Appl. No.: 662,317

[52] U.S. Cl. ..... 70/275; 70/DIG. 48

[51] Int. Cl.[2] ..... E05B 51/02

[58] Field of Search ..... 70/275, DIG. 48, DIG. 50, 70/278, 262, 263, 277, 282; 137/809, 552.5, 814, 822, 825; 235/201 PF, 201 FS; 317/134

[56] References Cited

UNITED STATES PATENTS

| | | | |
|---|---|---|---|
| 3,182,676 | 5/1965 | Bauer | 137/809 X |
| 3,320,490 | 5/1967 | Beck et al. | 70/278 |
| 3,416,550 | 12/1968 | Griffin | 137/809 |
| 3,495,776 | 2/1970 | O'Neill | 235/201 PF |
| 3,633,392 | 1/1972 | Bell et al. | 70/275 |
| 3,812,403 | 5/1974 | Gartner | 317/134 |
| 3,879,970 | 4/1975 | Salzmann et al. | 70/275 |
| 3,942,151 | 3/1976 | Takeuchi | 317/134 X |

*Primary Examiner*—Roy D. Frazier
*Assistant Examiner*—Rodney H. Bonck
*Attorney, Agent, or Firm*—Nathan Edelberg; A. Victor Erkkila; Max Yarmovsky

[57] ABSTRACT

A fluidic logic circuit is used to control access to a secured area by receiving pneumatic signals from a fluidic signal input transducer determining whether or not specific coded input requirements have been met. When all inputs to the signal input transducer are correct the fluidic logic circuit applies fluidic signals to valving which in turn provides fluid power to pneumatically operated latching devices. When one or more incorrect inputs from the signal input transducer are received by the fluidic logic, a dual signal is initiated by the fluidic logic which shuts off the power supply valve and prevents opening of the pneumatic latch.

3 Claims, 1 Drawing Figure

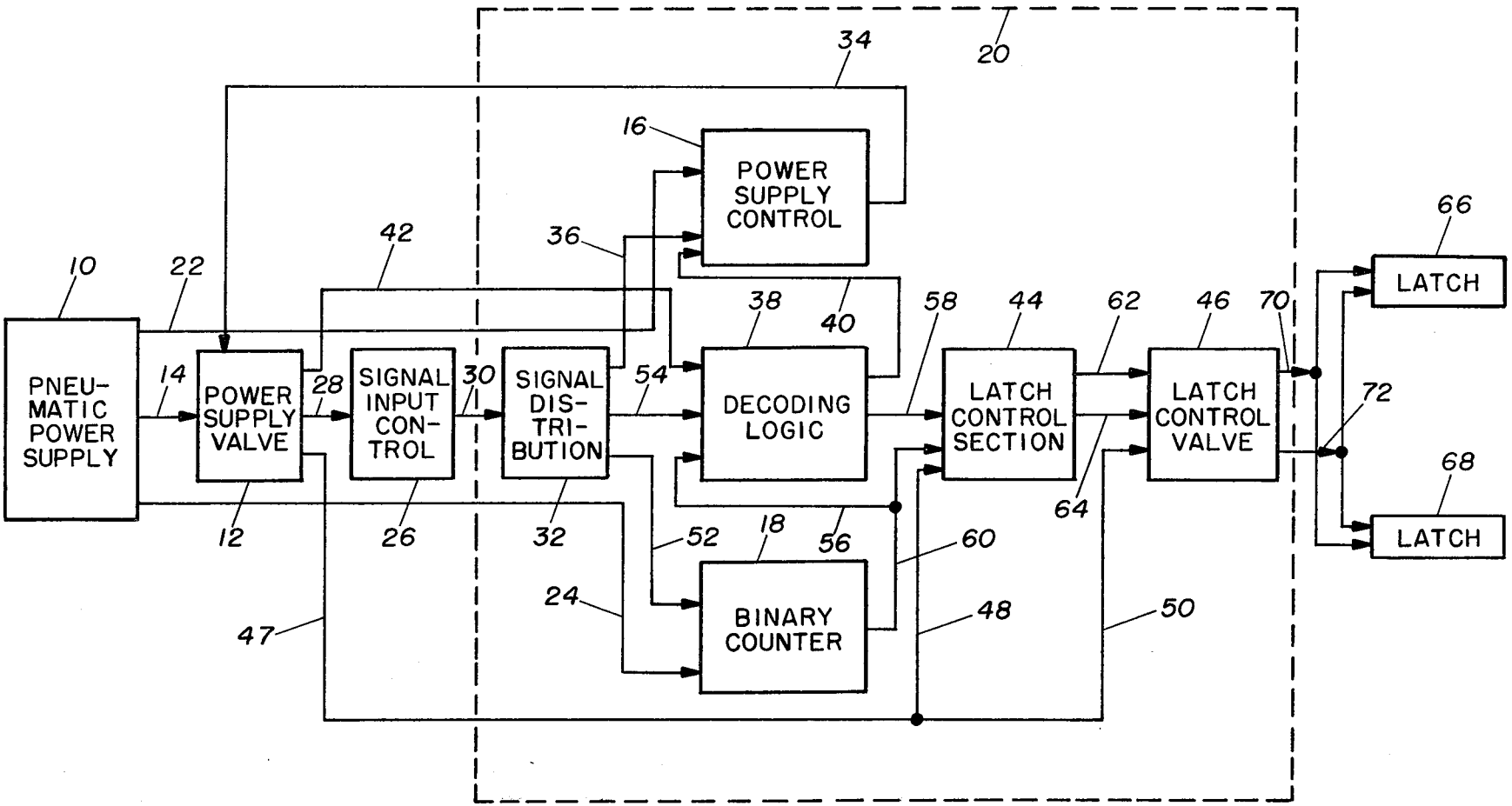
LATCH
LATCH
LATCH CONTROL VALVE
LATCH CONTROL SECTION
POWER SUPPLY CONTROL
DECODING LOGIC
BINARY COUNTER
SIGNAL DIS-TRI-BUTION
SIGNAL INPUT CON-TROL
POWER SUPPLY VALVE
PNEU-MATIC POWER SUPPLY
66
68
72
70
46
62
64
50
44
20
60
48
58
34
40
56
38
18
16
52
54
36
32
24
30
42
26
28
47
12
22
14
10

FLUID CONTROLLED SECURITY LOCK

GOVERNMENTAL INTEREST

The invention described herein may be manufactured, used and licensed by or for the Government for governmental purposes without the payment to me of any royalty thereon.

BACKGROUND OF THE INVENTION

Various means have been used in the past to control access to secured areas. The problem with the use of some prior art devices such as mechanical locks, electro-mechanical or electronic locking systems, and magnetic lock devices has been that lock opening means have been developed to defeat each of these prior art locking systems. The method for defeating these prior art locking devices has included picking, drilling, inducing currents, and the creation of random black box code generation systems. Locks employing electro-mechanical or electronic systems have limited use in areas containing hazardous materials because of the possibility of inadvertently causing a fire or an explosion because of a spark as the result of the make or break of a switch or the occurrence of a short circuit.

SUMMARY OF THE INVENTION

The present invention relates to a fluid controlled security lock which utilizes a portable pneumatic power supply to power a fluid logic control system. Power supply valving pneumatically connected to a signal input control panel permits the latter to provide a means for applying pneumatic signals to the fluid logic control system from outside the area being secured. A signal distribution network is used to route the signals from the signal input control panel to the proper logic sections of the fluidic logic control means. The fluidic logic control circuit comprises in addition to the signal distribution network a power supply control section, a binary counter section, a decoding logic section and a latch control section. The fluidic logic control system has a decoding function and a latch control function. The present system provides a virtually inert locking system, requiring no internal power or stored energy. Inert gases are utilized in externally powering the system. Thus hazards associated with electrical systems in explosive atmospheres or areas containing hazardous materials are eliminated. In the present invention the signal input control or code transducer is externally located whereas the fluidic logic is positioned in the secured area. Since these elements are widely separated, they are connected by pneumatic tubing which tends to eliminate the probability of by-passing or "fooling" of the locking system controlled by the fluidic circuitry.

An object of the present invention is to provide a fluid controlled lock for controlling access to a secured area.

Another object of the present invention is to provide a fluid controlled security lock system which utilizes an externally supplied inert gas to operate the system.

Another object of the present invention is to provide a fluid controlled locking system which requires no internal power or stored energy to operate the system.

Another object of the present invention is to provide a fluid controlled locking system which eliminates the hazards associated with electrical systems in explosive atmospheres, or areas containing hazardous materials.

A further object of the present invention is to provide a fluid controlled locking system having a signal input control or code transducer which is widely separated from the fluid logic to make it unlikely to by-pass or "fool" the fluidic circuitry and thus gain access to a secured area.

For a better understanding of the present invention, together with other and further objects thereof, reference is made to the following descriptions taken in connection with the accompanying drawing.

BRIEF DESCRIPTION OF THE DRAWING

The drawing shows a block diagram of the basic pneumatic elements of a fluid controlled security locking system.

DETAILED DESCRIPTION OF THE PREFERRED EMBODIMENTS

Referring now to the drawing, the pneumatic power supply 10 comprises a portable pressurized gas source, such as a gas cylinder, or a fixed gas source of sufficient capacity and pressure to power the system. The output of power supply 10 is penumatically connected to power supply valving 12 via pneumatic line 14 and to power supply control section 16 and binary control section 18, of the fluidic logic control circuit located within dash lines 20 by penumatic lines 22 and 24 respectively. The output of power supply valving 12 is pneumatically connected to a signal input control or code transducer 26 via pneumatic line 28. The signal input control 26 provides a means for applying pneumatic signals to the fluidic logic control circuitry 20. The signal input control 26 may utilize pressurized push button control valves arranged in an array labeled O through 9. A plurality of pneumatic signal outputs depending on the button number pushed are distributed to the fluidic logic circuitry within dash line 20 by pneumatic lines, represented by line 30, via a signal distribution section 32. Each separate valve or signal input of the signal input control 26 is connected to the fluidic logic control system through an individual signal line. The fluid logic control circuitry within dash line 20 has a decoding duding, and latching-unlatching function. The function of the signal distribution network 32 is to route pre-selected pneumatic signals from the signal input control panel 26 to the proper logic sections within the fluidic logic control circuit. The power control section 16 controls the operation of power supply valving 12 via pneumatic line 34 after receiving a properly sequenced input signal from the signal distribution 32 via pneumatic lines 36 and a signal from decoding logic section 38 via pneumatic line 40. The power supply valving 12 after being activated by power supply control section 16 through pneumatic line 34 provides pneumatic power to the decoding logic 38 via pneumatic line 42 and to the latch control section 44 and latch control valve 46 via pneumatic lines 47 and lines 48 and 50. The binary counter 18 monitors the number of signals received from the signal input control panel 26 thru the signal distribution 32 via pneumatic lines 52 and provides an output count signal equivalent to the number of signals received. The decoding logic section 38 compares the value of the signals routed to it, from the signal distribution network 32 via pneumatic lines 54 with the output count signal from binary counter 18 delivered through pneumatic lines 56. After making the comparison decoding logic 38 provides either an output unlatch signal via pneumatic lines 58 or an output dud signal to the power supply control section 16 via pneumatic line 40. The latch control section 44 after receiving proper input signals from the decoding logic 38 and binary counter 18, via pneumatic lines 58 and 60 respectively, generates a plurality of output signals which are delivered to pneumatically connected latch control valving 46 via pneumatic lines 62 and 64. The pneumatic actuated latches 66 and 68 are coupled to latch control valving 46 via pneumatic lines 70 and 72. The pneumatic latches 66 and 68 permit the opening and closing of a door to the secured area. The locking mechanism may be a dead bolt type device which is controlled by a pneumatic cylinder. With pneumatic power supplied to the entire fluidic lock circuit, the operation of the system can proceed. The code set, 6, 5, 4, 3, 2, 1, as previously given as an example, is put into the system by depressing each of the numbered buttons on the signal input control panel 26. Each input must be of the correct value and in the proper sequence for system operation. The pneumatic signals applied at the signal input are sent via individual pneumatic signal lines as represented by line 30 to the signal distribution network 32 which supplies the means for routing the signals from the signal input control 26 to the fluid logic control circuitry 20. From the signal distribution network 32 the incoming pneumatic signals are routed via pneumatic lines 36, 52 and 54 to the power supply control 16, binary counter 18 and the decoding logic 38 respectively. Each incoming signal increases the count retained in the binary counter 18 by a count of one. The count is transferred to the decoding logic via pneumatic lines 56. The decoding logic comprises AND-NAND logic which is utilized to compare the "value" of the incoming pneumatic signal via pneumatic lines 54 from the signal distribution panel 32 with the binary count signal generated by the binary counter 10. Each decoding logic stage of the comparing circuit is dependent upon a specific signal "value" and count as determined by the pneumatic connections set within the signal distribution network 32. In the present instance, the first decoding logic stage corresponds with signal value 6 and a first count; the second decoding logic stage corresponds to a signal value 5 and a second count, etc., with the sixth decoding logic stage corresponding to a signal value 1 and a sixth count. As each signal is sent by the signal input control 26 via signal distribution network 32, it is compared with the count from binary counter 18 and if the signal "value" and the count correspond the AND logic is actuated. These AND signals are then transferred to another "anding" network within decoding logic 38 which requires 6 AND signals from the comparing circuit in order to provide an AND output.

In operation, the fluid controlled lock has been set so that a six digit input signal is required in a given order, i.e. 6, 5, 4, 3, 2, 1. Pneumatic power from the power supply 10 is applied to the system and distributed via pneumatic lines 14, 22 and 24 to the power supply valving 12, the power supply control 16, and the binary counter 18. The power supply control 16 comprises a biased inhibited OR-NOR pneumatic circuit, and a multiple input sensing circuit. The inhibited OR-NOR pneumatic logic circuit functions as an OR-NOR gate biased to the OR state, with the addition of an overriding inhibit function which switches the logic to the NOR state and holds it in this state once a dud signal is received via pneumatic line 40. The multiple input sensing circuit monitors all signals coming into the fluidic logic circuit from the signal input control 26. These signals from the input control 26 are routed via pneumatic lines 30 into the signal distribution network 32 which in turn directs then via pneumatic lines 36 into an AND-NAND logic circuit within power supply control 16. The AND-NAND logic, which makes up the multiple sensing circuit previously mentioned, provides an AND signal to the dud input of the inhibited OR-NOR logic circuit when two or more concurrent pneumatic signals are received from the signal input control panel 26 at any given time. In addition, and AND signal is provided when a pneumatic signal not used in the code set is sent from the signal input control panel 26. For the present code example state, inputs of 7, 8, 9, or 0 are connected within the signal distribution network such that they will appear to be a multiple input and as such, if either 7, 8, 9, or 0 are put into the system, a dud signal occurs.

When power is applied to the power supply control section 16 the biased inhibited OR-NOR logic sends a signal via pneumatic line 34 to the power supply valving 12 which in turn opens, supplying pneumatic power via pneumatic lines 42 and 47 to the decoding logic 38, the latch control section 44 and the latch control valving 46 respectively. When all six inputs are of the correct value and in the proper order, the decoding logic 38 is "ANDED", with an output signal being transferred via pneumatic line 58 to the latch control section 44. In the event that the signal input values do not correspond with the count, there is a NAND output signal provided by the decoding logic 38 which is then combined with the sixth count. The combination of the sixth count and the NAND output are sent via pneumatic line 40 as a dud signal to the inhibited OR-NOR circuit within the power supply control 16 at which time the system is duded. The latch control section 44 combines the AND output and no-dud signal of the decoding logic 58 and the sixth count from the binary counter 18 delivered via pneumatic lines 58 and 60 respectively, to provide two outputs which are delivered to the latch control valving 46 via pneumatic lines 62 and 64. One output signal from latch control section 44 generates a lock signal which causes latch valving 46 to hold latches 66 and 68 in a closed position. The other output signal generates an un-lock signal which causes valving 46 to be positioned so that the latches 66 and 68 are opened and so that access may be gained to the secured area.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A fluidic locking system for controlling access to a secured area which comprises:

means for providing pneumatic power to said fluidic locking system:

signal input control means, pneumatically connected to said means for providing pneumatic power, for generating a plurality of pneumatic output signals therefrom in response to mechanical stimuli;

fluidic logic control circuit means, pneumatically connected to said means for providing pneumatic power and to said signal input control means, for decoding said output signals received from said signal input control means and for generating a dud signal, a latch signal or an un-latch signal in response to said pneumatic output signals, which includes;

signal distribution means, pneumatically connected to said signal input control means, for routing pneumatic signals from said signal input control means to said fluidic logic control circuit means;

binary counter means having an input, pneumatically coupled to said means for providing pneumatic power and said signal distribution means, for monitoring the number of signals received from said signal input control means and for providing an output count signal equivalent to the number of signals received;

decoding logic means, pneumatically connected to the output of said means for providing pneumatic power, and signal distribution means and said binary counter means, for comparing the value of the pneumatic signals, routed thereto from said signal distribution means, with the output count signal delivered thereto from said binary counter means, and for providing either said output un-latch signal or said output dud signal to said fluidic locking system;

power supply control means, pneumatically coupled to said means for providing pneumatic power and signal distribution means and said decoding logic means, for controlling the operation of said means for providing power after said power supply control means receives a properly sequenced input signal from the output of said signal distribution means and said decoding logic means; and latch control means, pneumatically connected to said means for providing pneumatic power, said binary counter means, and said decoding logic means, for providing a lock signal in response to said dud signal, said lock signal maintaining said fluidic locking system in a closed position and for providing said un-latch signal to operate said fluidic locking system so that access may be gained to said secured area; and latch means, pneumatically coupled to said fluidic logic control circuit means and responsive thereto, for opening said fluidic locking system to said secured area in response to said un-latch signal and for maintaining said locking system in a closed state in response to said dud signal and in response to said latch signal.

2. A fluidic locking system as recited in claim 1 wherein said means for providing pneumatic power comprises:

a pneumatic power supply;

a power supply valve having an input pneumatically connected to said means for providing pneumatic power and to said fluidic logic control circuit means, and an output pneumatically connected to said signal input control means and to said fluidic logic control circuit means.

3. A fluidic locking system as recited in claim 2 wherein said latch control means comprises:

a latch control section, pneumatically connected to said decoding logic, said binary counter and said power supply valve which combines an AND output and a no-dud signal of said decoding logic and a count signal from said binary counter to provide latch control section outputs, in response thereto; and latch control valve pneumatically coupled to said latch control section and said power supply valve, said latch control valve being positioned by said latch control section output to either pneumatically open or close said latch means and thereby permit or prohibit access to said secured area.

* * * * *